US009562398B2

(12) United States Patent
Zhang et al.

(10) Patent No.: US 9,562,398 B2
(45) Date of Patent: Feb. 7, 2017

(54) MODULAR CUTTING-TEETH DRILL BIT WITH CONTROLLABLE DRILLING SPECIFIC PRESSURE

(71) Applicant: Sichuan Deep & Fast Oil Drilling Tools Co., Ltd., Chengdu, Sichuan (CN)

(72) Inventors: Liang Zhang, Sichuan (CN); Shu Li, Sichuan (CN); Jialin Tian, Sichuan (CN); Defa Zeng, Sichuan (CN)

(73) Assignee: Sichuan Deep & Fast Oil Drilling Tools Co., Ltd, Chengdu, Sichuan Province (CN)

( * ) Notice: Subject to any disclaimer, the term of this patent is extended or adjusted under 35 U.S.C. 154(b) by 661 days.

(21) Appl. No.: 13/924,239

(22) Filed: Jun. 21, 2013

(65) Prior Publication Data

US 2013/0341100 A1 Dec. 26, 2013

(30) Foreign Application Priority Data

Jun. 21, 2012 (CN) ..... 2012 1 0207165

(51) Int. Cl.

| | |
|---|---|
| ***E21B 10/46*** | (2006.01) |
| ***E21B 10/567*** | (2006.01) |
| ***E21B 10/00*** | (2006.01) |
| ***E21B 10/50*** | (2006.01) |
| *E21B 10/54* | (2006.01) |
| *E21B 10/56* | (2006.01) |

(52) U.S. Cl.

CPC ..... *E21B 10/46* (2013.01); *E21B 10/00* (2013.01); *E21B 10/50* (2013.01); *E21B 10/5676* (2013.01); *E21B 2010/545* (2013.01); *E21B 2010/563* (2013.01)

(58) Field of Classification Search

CPC ..... E21B 10/5673; E21B 10/46; E21B 10/54; E21B 10/545; E21B 10/55; E21B 10/567; E21B 10/5676; E21B 2010/563; E21B 2010/545

USPC ..... 175/428, 430, 432, 426, 434

See application file for complete search history.

(56) References Cited

U.S. PATENT DOCUMENTS

| | | | | |
|---|---|---|---|---|
| 5,238,074 | A * | 8/1993 | Tibbitts et al. | 175/428 |
| 7,845,438 | B1 * | 12/2010 | Vail et al. | 175/434 |
| 2009/0020339 | A1 * | 1/2009 | Sherwood, Jr. | 175/426 |
| 2013/0167449 | A1 * | 7/2013 | Lin et al. | 51/309 |

* cited by examiner

*Primary Examiner* — George Gray

(57) ABSTRACT

A modular cutting-teeth bit having controllable specific pressure for drilling includes: a module (1), a modular unit (2), a bit body (3), conventional cutting teeth (4) and a nozzle (5). According to mechanical performance of the rocks in the strata drilled and requirements of drilling well, a combination of shapes, sizes and numbers of the module and the modular unit is optimized; effective abrasion edge length of the cutting unit on a certain portion of the bit is controlled; and a constant specific pressure of the cutting unit of the bit during the drilling process is maintained.

1 Claim, 15 Drawing Sheets

MODULAR CUTTING-TEETH DRILL BIT WITH CONTROLLABLE DRILLING SPECIFIC PRESSURE

BACKGROUND OF THE PRESENT INVENTION

Field of Invention

The present invention relates to fields of technical equipment for oil-gas drilling engineering, mining, geological drilling, construction engineering, tunneling engineering, shield tunneling, trenchless engineering and etc., and more particularly to drill bit with modular cutting-teeth arrangement and having controllable drilling specific pressure.

Description of Related Arts

Bits are tools which directly contact with rocks and break the rocks by effects such as cutting and stamping during drilling process. Polycrystalline Diamond Compact Bits (PDC bits) which break the rocks by cutting and shearing are getting more and more extensive application in drilling engineering, geological engineering and even architectural engineering. The application proportion of the PDC bits in the drilling engineering is getting larger and larger. In a perfect operating condition that a center line of bit coincides with the borehole axis, motion trajectories of all the cutting teeth are relatively fixed concentric-circles during the bit drilling process. Due to rock breaking mechanism and structural differences, the PDC bits are more suitable for soft and medium-hard strata with high ROP (penetration rate). The characteristics of PDC bits include the following.

(1) Manner of Breaking the Rock

The PDC bits cut, shear and break rock depending on the compacts. According to abrasive property of the rocks, continuous or intermittent contacts and frictions are generated between the rocks and the bits during the rock-breaking process.

(2) Relationship Among Cutting-edge Length, Specific Pressure and ROP of the Cutting Element While the bit is breaking rocks, the bit itself is gradually getting blunt by the abrasion of the rocks simultaneously, i.e., the cutting-edge length is increased. Therefore, the relationship among the cutting-edge length, the specific pressure and the ROP is as following. In the preliminary stage of drilling by the bit, an abrasion line of the cutting element is short, the specific pressure thereof is high, rock-breaking efficiency thereof is high and the ROP thereof is high as well. As the abrasion line thereof is gradually getting longer, the specific pressure thereof becomes lower, relative abrasion of the cutting element to the rocks is increasing, and the ROP thereof is gradually reducing until the bit is failure. For example, if a Φ16 mm circular compact bit serves as the cutting element and is drilling the medium-hard strata, the bit usually becomes failure when the cutting-edge length of the compact is approximately 80% of a diameter thereof. A sharp increase of the cutting-edge length will greatly reduce the breaking efficiency of the bit to the rocks and the drilling efficiency thereof accordingly.

(3) Relationship Among Abrasion Ratio of the Cutting Element, Effective Abrasion Volume and Service Life of the Bits For a compact having a definite abrasion ratio, the greater the effective abrasion volume, the greater the effective utilization rate of the compact of the bit, and the higher the drilling depth, the longer the service life of the bit. For example, if the Φ16 mm circular compact bit serves as the cutting element and is drilling the medium-hard strata, actual abrasion volume of diamond layer of the compact is less than 20% of the total volume. Thus, without considering the effects of the impact damage, choosing a compact having a high abrasion ratio is conductive to prolonging the service life of the bit.

In order to improve performances of the compact, researcher from China and other countries have studied on several aspects such as cross-sectional shape of the PDC bits, back rake angle, cutting-teeth size and the teeth-arrangement density. However, the problem does not be solved effectively that the actual abrasion volume of the diamond layer is just a very small proportion of the total diamond volume which shorten the bit service life.

SUMMARY OF THE PRESENT INVENTION

The present invention provides a modular cutting-teeth drill bit with controllable drilling specific pressure, which by improving teeth arrangement and adopting modular cutting teeth, a controllable specific pressure is achieved and an effective abrasion volume of a cutting element is increased, and therefore, the effect of improving ROP and the bit performances is accomplished.

Accordingly, in order to accomplish the above objects, technical solutions provided by the present invention are as following.

A modular cutting-teeth drill bit with controllable drilling specific pressure, comprises a bit body (3) and at least a cutting tooth (4), wherein the cutting tooth (4) comprises a module (1) and a plurality of modular units (2) for serving as matrix; a number of the module (1) on one bit is not less than one, and a number of the modular units (2) provided on is not less than 2.

The modular unit mainly serves as a cutting portion.

Hereinafter, the cutting teeth constituted by the module (1) and the modular unit (2) is called a cutting element or a modular cutting element.

Connecting manners of the module and the bit body comprise welding, inlaying, bonding and screw thread and etc.

Connecting manners of the module and the bit body comprise welding, inlaying, bonding, screw thread and clamping and etc.

A cross-section shape of the modular unit comprises a circle, an ellipse, a racetrack, a drum, a fan, a triangle, a rectangle, a square, a trapezoid, a rhombus, a polygon (edges ≥5) and a annular thereof; and combination of the shapes mentioned above. A shape of the modular unit is selected from the group consisting of a cylinder, a cone, a sphere, a waist drum, a hollow body and an allotrope and a combination shape thereof.

A shape of the modular unit is a cylinder, a diameter thereof is 1 mm~25 mm and a height thereof is 3 mm~25 mm.

A combination manner of the modular unit comprises combination of same modular units (e.g., a combination of a plurality of circular units with a same size, or a combination of a plurality of ellipse units with a same size) and combination of different modular units (e.g., a combination of two modular units with different sizes, or a combination of a circular unit and a ellipse unit).

The modular unit distribution manner comprises regular distribution and irregular distribution.

Distance can be provided between combinations of the modular units, and no provided distance there between is also all right, i.e., a modular unit distance value among each combination of the modular unit is greater than or equal to 0 mm.

A part or a whole of the modular unit is included in the module.

A cutting surface of the modular unit is exposed on a surface of the module, or embedded in the surface of the module A material of the modular unit comprises cemented carbide, a Polycrystalline Diamond Compact or body, a thermally stable polycrystalline diamond, a synthetic diamond impregnated block, a natural diamond impregnated block, a cubic boron nitride or ceramic, and a composite comprising the cemented carbide, the diamond or the cubic boron nitride.

The modular unit is processed by hot pressing, sintering, electric discharge machining, and laser processing or machining, so as to be molding.

A cross-section shape of the module is selected from a circle, an ellipse, a racetrack, a drum, a fan, a triangle, a rectangle, a square, a trapezoid, a rhombus, a polygon (edges ≥5).

A shape of the module is selected from the group consisting of a cylinder, a cone, a sphere, a waist drum, a hollow body, an allotrope.

A shape of the module is a cylinder, a diameter thereof is ≥2 mm and a height thereof is 3 mm~25 mm.

When the number of the module is not less than 2, a combination manner of the module comprises combination of same modular units (e.g., a combination of a plurality of circular modules, or a combination of a plurality of ellipse modules) and combination of different modular units (e.g., a combination of a plurality of modules with different sizes, or a combination of at least a circular module and at least an ellipse module).

When the number of the module is not less than 2, a distance can be or not be provided between modules on the bit body, i.e., a module distance value among two of the modules is greater than or equal to 0 mm.

A part or a whole of the module is included in the bit body.

The module serves as a part or a whole of a blade of the bit body.

A material of the module comprises steel, cemented carbide, powder metallurgy material, nonferrous metal and composite material.

The module is molded by sintering, pressing, casting, electric discharge machining and laser processing or machining.

Types of the modular cutting-teeth bit of the present invention comprise a PDC bit, a diamond bit, an impregnated bit, a roller bit, a cone-cutting bit, and a compact bit comprising at least two number selected from the group consisting of the PDC bit, the impregnated bit, the roller bit and the cone-cutting bit. The modular cutting-teeth bit comprise at least one cutting element formed by one module and one modular unit.

A material of the bit body comprises a sintered body of tungsten carbide and alloy, steel, cemented carbide and metal matrix composite During a drilling process of the modular cutting-teeth drill bit, an effective cutting length that an edge of the cutting element contacts with the rocks is controlled in a certain range, so as to ensure a higher specific-pressure value and improve an average ROP of the bit. Combined with parameters of the bit body (including matrix and steel body), the modular cutting-teeth drill bit is capable of increasing an effective abrasion volume of the cutting-teeth unit, improving an effective utilization rate of the cutting element, and prolonging a service life of the bit. Under complicated geological condition, especially in hard strata or high abrasive strata, the modular cutting-teeth drill bit is capable of achieving substantial increase in total length of well drilling. The present invention comprises, but not limited to, aspects as following.

(1) Design of Structures of the Modular Unit

By designing structures of the modular unit and connecting matrix of the module with the modular unit, a modular unit having a small size is developed, so as to constitute a cutting-teeth unit, which changes structures of the cutting element.

(2) Material Performances of the Modular Unit

High-performance (especially impact resistance and high abrasion resistance) material of the modular unit is adopted, so as to achieve working in deep well and abrasive strata.

(3) Design of the Module Structures

The module structures are designed to ensure that the cutting edge of the cutting element is in a certain range, so as to improve the ROP and prolong the service life of the bit.

(4) Material Performances of the Module

Matrix material having high strength and low abrasion resistance is adopted, in such a manner that when abrasion volume of the cutting element increases, the specific pressure thereof is not decreased, so as to improve an average ROP of the bit.

(5) Material Performances of the Bit Body

High strength and low abrasion resistance material of the bit body is adopted, in such a manner that when an abrasion volume of the cutting element increases, the specific pressure thereof is not decreased, so as to improve the average ROP of the bit.

Compared with the conventional art, the modular cutting-teeth drill bit with controllable drilling specific pressure according to a preferred embodiment of the present invention has characteristics as following.

1. Optimized Cutting-Edge Length of the Cutting Element

In conventional art, with drilling of the bit, the effective cutting length of the cutting element increases, which leads to decrease of the specific pressure, and decline of drilling performance of the bit. In the modular cutting-teeth drill bit according to a preferred embodiment of the present invention, parameters are designed by shapes, numbers, combination and etc. of the module and the modular unit. Considering parameters of the bit pressure and properties of the rocks, the cutting-edge length of the cutting element is optimized, in such a manner that the effective cutting length of the cutting element is controlled in a certain range.

2. Ensured Drilling Specific Pressure of the Cutting Element

With the increase of drilling depth, the cutting-edge length of the cutting element of the modular cutting-teeth drill bit is still controlled within certain range. According to relationship between the cutting-edge length and the specific pressure, a controlled cutting-edge length is capable of ensuring that the specific pressure of the cutting element is in a certain range during the drilling process, i.e. the specific pressure of the edge of the cutting element maintains in the bit, so as to maintain the ROP thereof.

3. Enhanced ROP

According to relationship among the cutting-edge length, the specific pressure and the ROP, increase of the cutting-edge length dramatically reduces breaking efficiency of the rocks the ROP. In modular design of the modular cutting-teeth drill bit, the cutting-edge length is controlled in a certain range, thus, as the drilling depth increases, the specific pressure still maintains a greater drilling depth corresponding to the bit pressure and properties of the rocks, so as to ensure penetration of the cutting element and realize improving the ROP of the bit.

4. Improved Effective Utilization Rate

For example, if a Φ16 mm circular compact bit serves as the cutting element and is drilling the medium-hard strata, the bit usually becomes failure when the cutting-edge length of the compact is approximately 80% of a diameter thereof. Actual abrasion volume of diamond layer of the compact is less than 20% of the total volume of the diamond, and the effective utilization rate of the cutting element is low. Combining with parameters of material of the bit body, the modular cutting-teeth drill bit improves the effective abrasion volume of the cutting element by a small cutting-edge length, a large specific pressure, so as to improve the effective utilization rate of the cutting element. I.e., with increase of the effective abrasion volume of the cutting element, the modular cutting-teeth drill bit is still capable of maintaining the specific pressure required for drilling and ensuring penetration of the bit to strata, in such a manner that the effective utilization rate of the cutting element is improved.

5. A Prolonged Service Life of the Bit

The service life of the bit is related to the effective utilization of the cutting element. In the conventional art, increase of the cutting-edge length of the cutting element dramatically reduces the breaking efficiency of the rocks, i.e., when the cutting-edge length reaches a maximum value, the specific pressure is in a minimum value, the penetration length of the cutting element is in a minimum value, and the ROP reaches a minimum value as well. Accordingly, with increase of the effective abrasion volume of the cutting element, the modular cutting-teeth drill bit is still capable of maintaining the specific pressure required for drilling and ensuring penetration of the bit to strata, in such a manner that the effective utilization rate of the cutting element is improved and the service life of the bit is prolonged.

6. Increased Total Drilling Depth

The total drilling depth is final indicator for testing performances of the bit, which is reflected in two aspects: the ROP and the service life of the bit. With a manner of modular tooth-arrangement, the modular cutting-teeth drill bit according to a preferred embodiment of the present invention is capable of ensuring a controllable specific pressure and improving the ROP. Meanwhile, by increasing the effective abrasion volume of the cutting element, the modular cutting-teeth bit improves the effective utilization rate of the cutting element, and finally increases the total drilling depth.

The present invention has the following beneficial effects of:

(1) significantly improving the average ROP of the bit, wherein according to mechanical performance of the rocks and requirements of drilling well in the strata drilled, a combination of shapes, sizes and numbers of the module and the modular unit is optimized; effective abrasion edge length of the cutting element on a certain portion of the bit is controlled; a constant specific pressure of the cutting element of the bit during the drilling process is maintained; and the average ROP of the bit is significantly improved;

(2) prolonging the service life of the bit, wherein combining with parameters of material of the bit body, the modular cutting-teeth bit substantially improves the effective abrasion volume of the cutting element, improves the effective utilization rate of the cutting element, and prolongs the service life of the bit; and (3) reducing costs of the drilling, wherein the modular cutting-teeth bit is not only capable of substantially improving the average ROP and the drilling depth of the bit under conditions of complex geology, especially in the hard strata and the abrasive strata, but also prolonging the service life of the bit and reducing the costs of the drilling.

Combining with parameters of material of the bit body, the modular cutting-teeth bit improves the effective abrasion volume of the cutting element by a small cutting-edge length, a large specific pressure, so as to improve the effective utilization rate of the cutting element. I.e., with increase of the effective abrasion volume of the cutting element, the modular cutting-teeth bit is still capable of maintaining the specific pressure required for drilling and ensuring penetration of the bit to strata, in such a manner that the effective utilization rate of the cutting element is improved.

These and other objectives, features, and advantages of the present invention will become apparent from the following detailed description, the accompanying drawings, and the appended claims.

DETAILED DESCRIPTION OF THE PREFERRED EMBODIMENT

Embodiment 1: Solution 1 of a Modular Cutting Element

Figure 3:
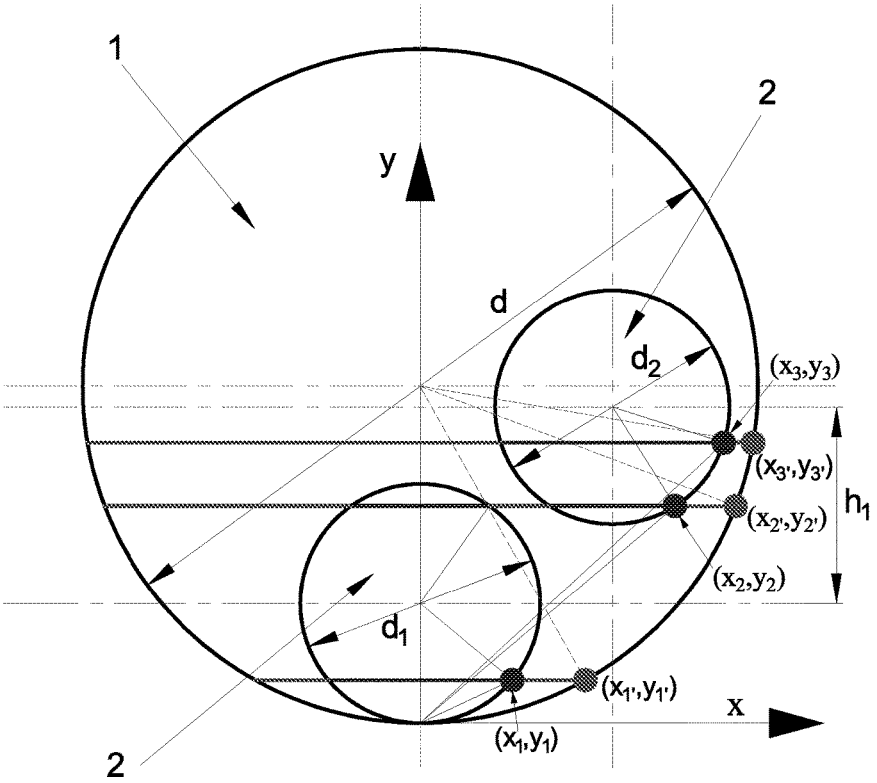
FIG. 3 is a structural sketch view of a first combination manner of the modular cutting element according to an embodiment 1 of the present invention.
Figure 4:
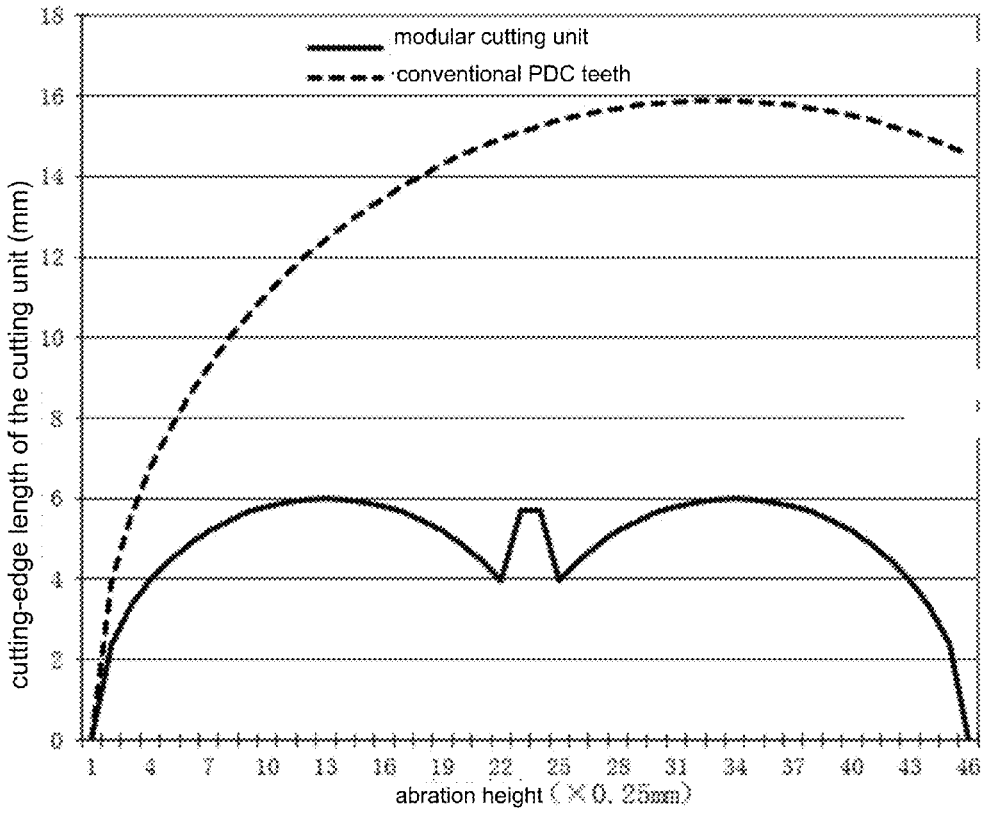
FIG. 4 is a contrast diagram of the modular cutting element of the embodiment 1 of the present invention to distribution rule of a cutting-edge length of conventional PDC teeth.

As shown in FIG. 3 of the drawings, a number of the modular unit is 2. Cross-section shapes of a module and the module unit are circles. A diameter of the module is d. Two kinds of modular units are provided. A total number of two modular units are provided, which are respectively a modular unit 1 and a modular unit 2. Diameters of the modular unit 1 and the modular unit 2 are respectively $d_1$ and $d_2$. A center distance along a Y axis direction of the modular unit 1 to the modular unit 2 is $h_1$, wherein $$0 \le h_1 \le \frac{d_1 + d_2}{2}.$$

Embodiment 2: Solution 2 of the Modular Cutting Element

Figure 5:
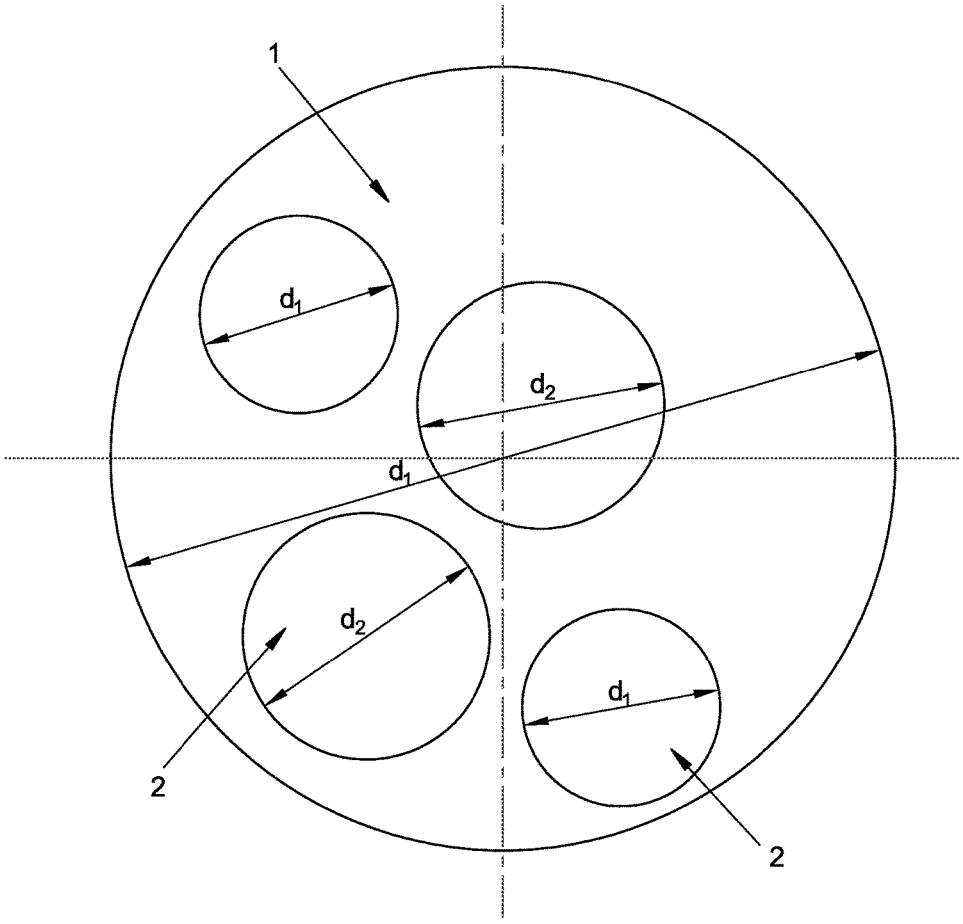
FIG. 5 is a structural sketch view of a second combination manner of the modular cutting element according to an embodiment 2 of the present invention.
Figure 6:
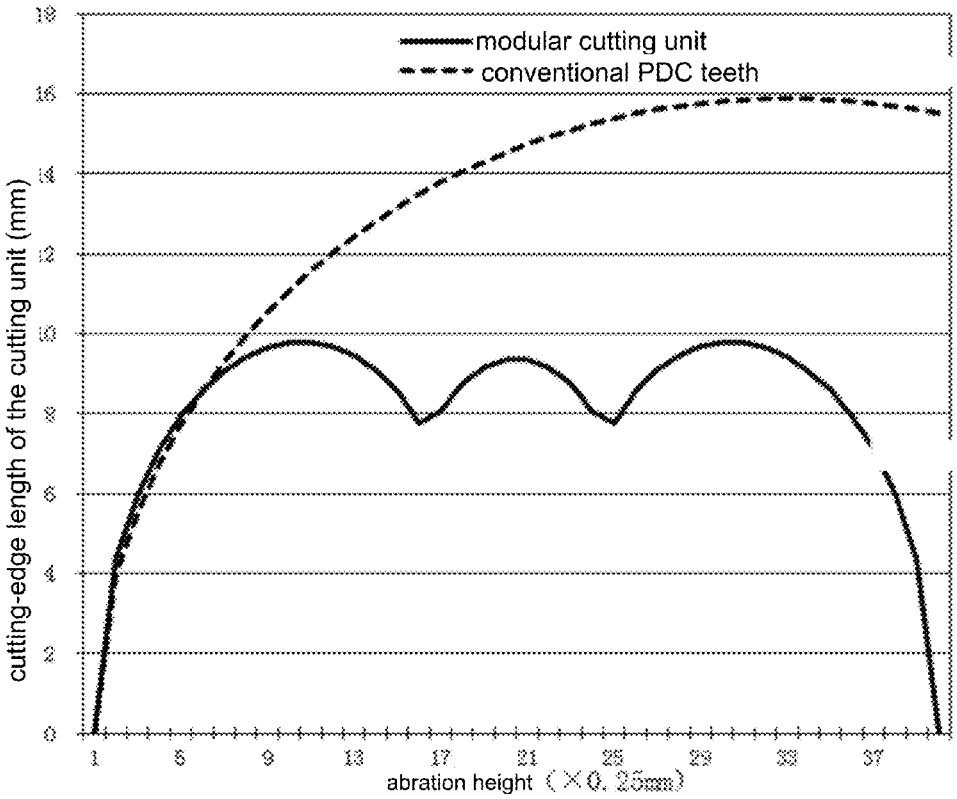
FIG. 6 is a contrast diagram of the modular cutting element of the embodiment 2 of the present invention to the distribution rule of the cutting-edge length of the conventional PDC teeth.

As shown in FIG. 5 of the drawings, a modular cutting-teeth drill bit with controllable drilling specific pressure comprises the module (1) and the modular unit (2). Cross-section shapes of the module and the modular unit are circles. All the modular units are in the module. A distance is provided between each two modular units. A diameter of the module is d. Two kinds of modular units are provided, wherein a total number of the modular unit is 4. Diameters of the two kinds of modular units are respectively $d_1$ and $d_2$.

Embodiment 3: Solution 3 of the Modular Cutting Element

Figure 7:
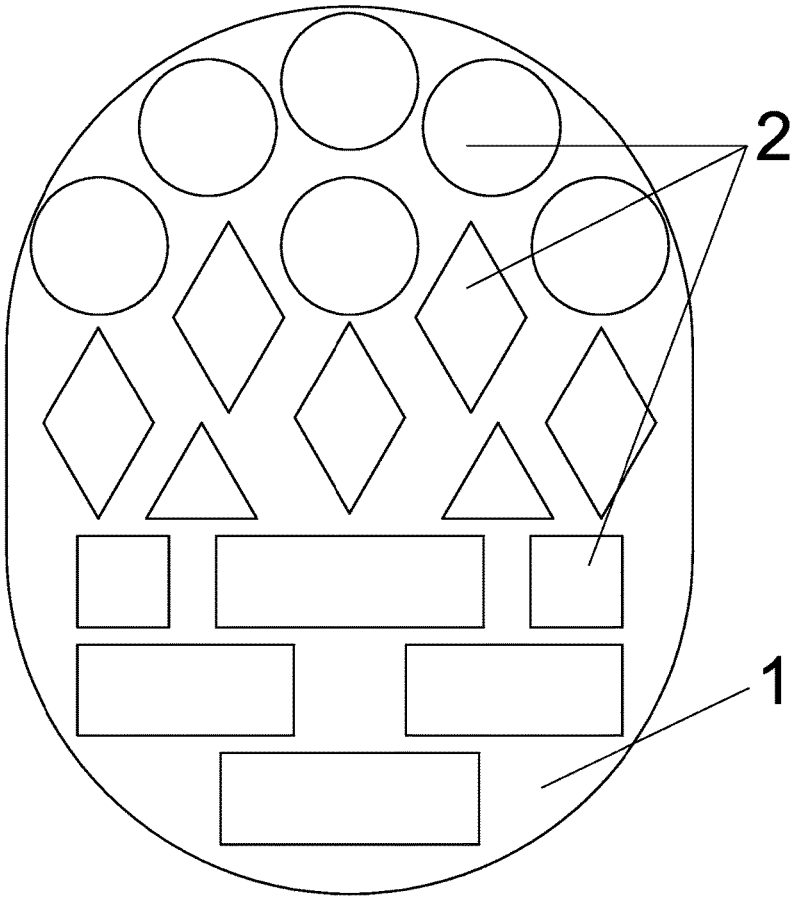
FIG. 7 is a structural sketch view of a third combination manner of the modular cutting element according to an embodiment 3 of the present invention.

As shown in FIG. 7 of the drawings, a modular cutting-teeth drill bit with controllable drilling specific pressure comprises the module (1) and the modular unit (2). A cross-section of the module is in a racetrack shape. Cross-section shapes of the modular unit comprise circular, rhombus, triangle and rectangle, which are regularly distributed.

Embodiment 4: Solution 4 of the Modular Cutting Element

Figure 8:
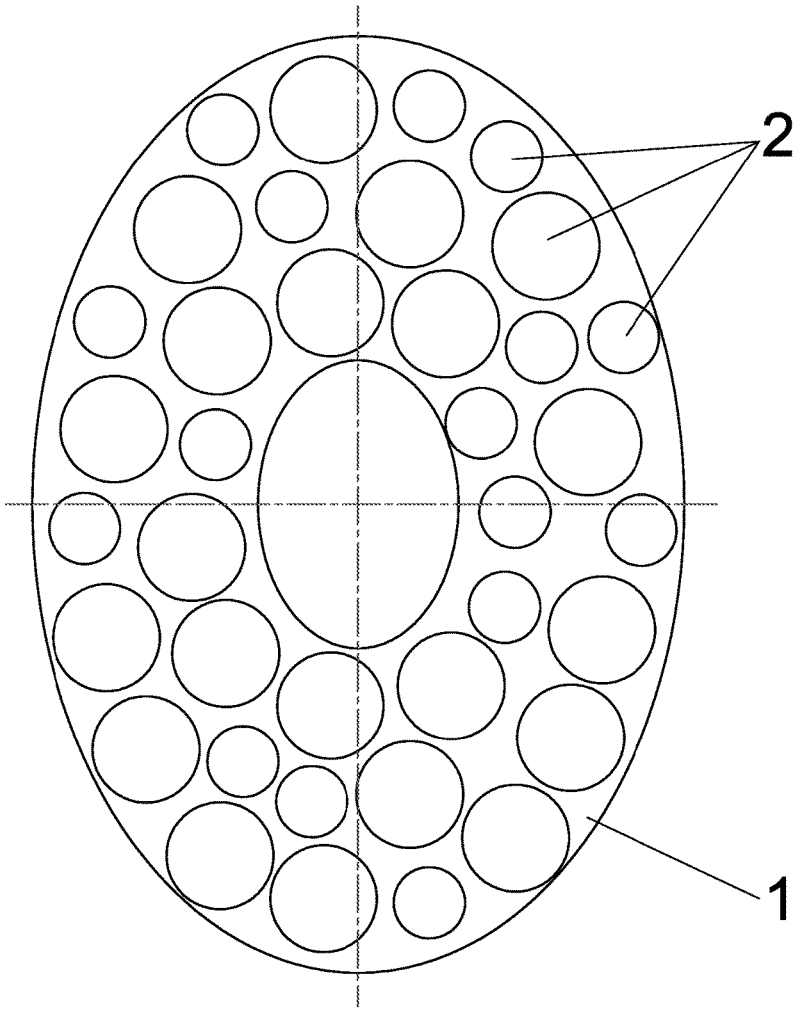
FIG. 8 is a structural sketch view of a fourth combination manner of the modular cutting element according to an embodiment 4 of the present invention.

As shown in FIG. 8 of the drawings, a modular cutting-teeth drill bit with controllable drilling specific pressure comprises a module (1) and modular units (2). A cross-section shape of the module is a hollow ellipse. Cross-section shapes of the modular units are circulars which have different sizes and are irregularly distributed.

Embodiment 5: Solution 5 of the Modular Cutting Element

Figure 9:
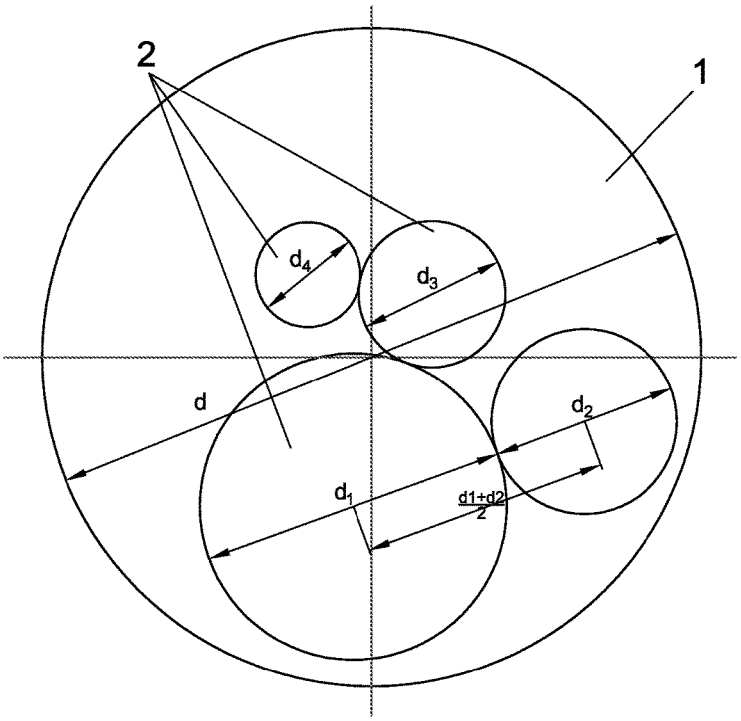
FIG. 9 is a structural sketch view of a fifth combination manner of the modular cutting element according to an embodiment 5 of the present invention.

As shown in FIG. 9 of the drawings, a modular cutting-teeth drill bit with controllable drilling specific pressure comprises a module (1) and modular units (2). The modular units can also be provided with no distance therebetween, i.e., distance values between some of the modular units are 0 mm.

Embodiment 6: Solution 6 of the Modular Cutting Element

Figure 10:
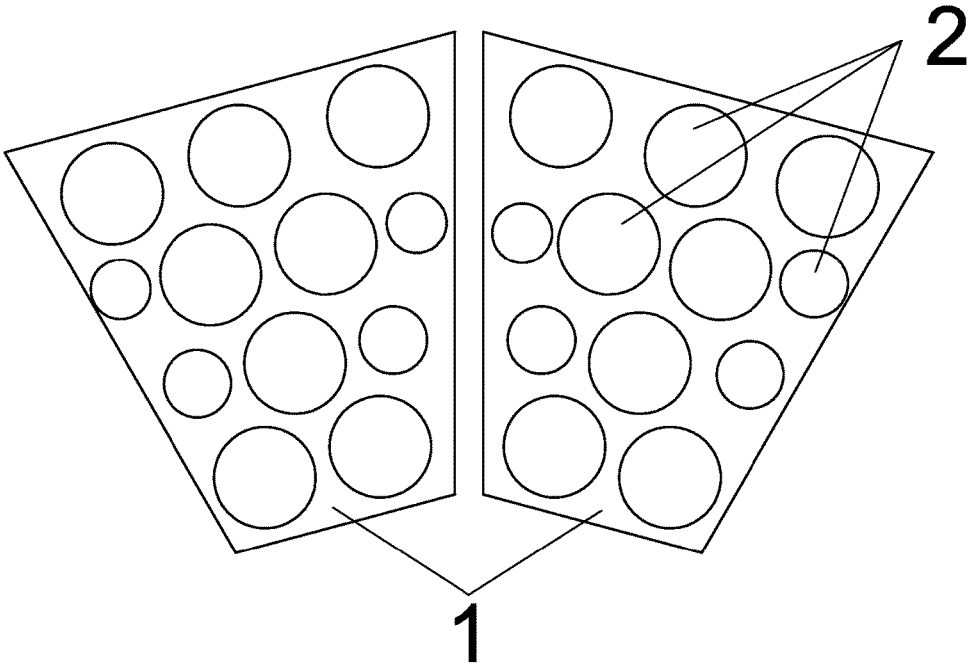
FIG. 10 is a structural sketch view of a sixth combination manner of the modular cutting element according to an embodiment 6 of the present invention.

As shown in FIG. 10 of the drawings, a modular cutting-teeth drill bit with controllable drilling specific pressure comprises modules (1) and modular units (2). Combination manner thereof are modules of a same kind, wherein a cross-section of the modules are in trapezoid shape.

Embodiment 7: Solution 7 of the Modular Cutting Element

Figure 11:
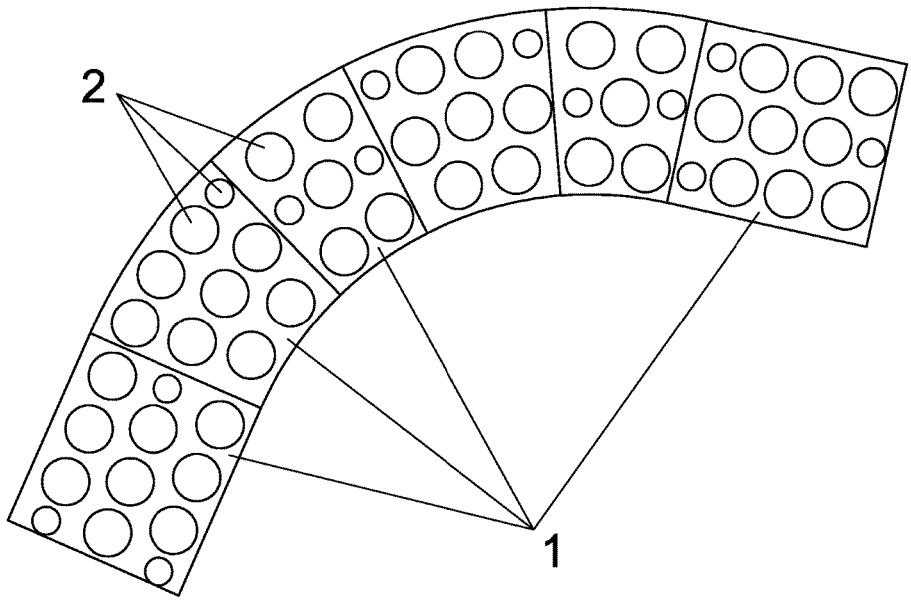
FIG. 11 is a structural sketch view of a seventh combination manner of the modular cutting element according to an embodiment 7 of the present invention.

As shown in FIG. 11 of the drawings, a modular cutting-teeth drill bit with controllable drilling specific pressure comprises modules (1) and modular units (2). Combination manner thereof is modules of a different kind, wherein a cross-section of the modules are in a fan shape or a rectangle shape, i.e., a combination of a fan shape and a rectangle shape.

Embodiment 8: Solution 8 of the Modular Cutting Element

Figure 12:
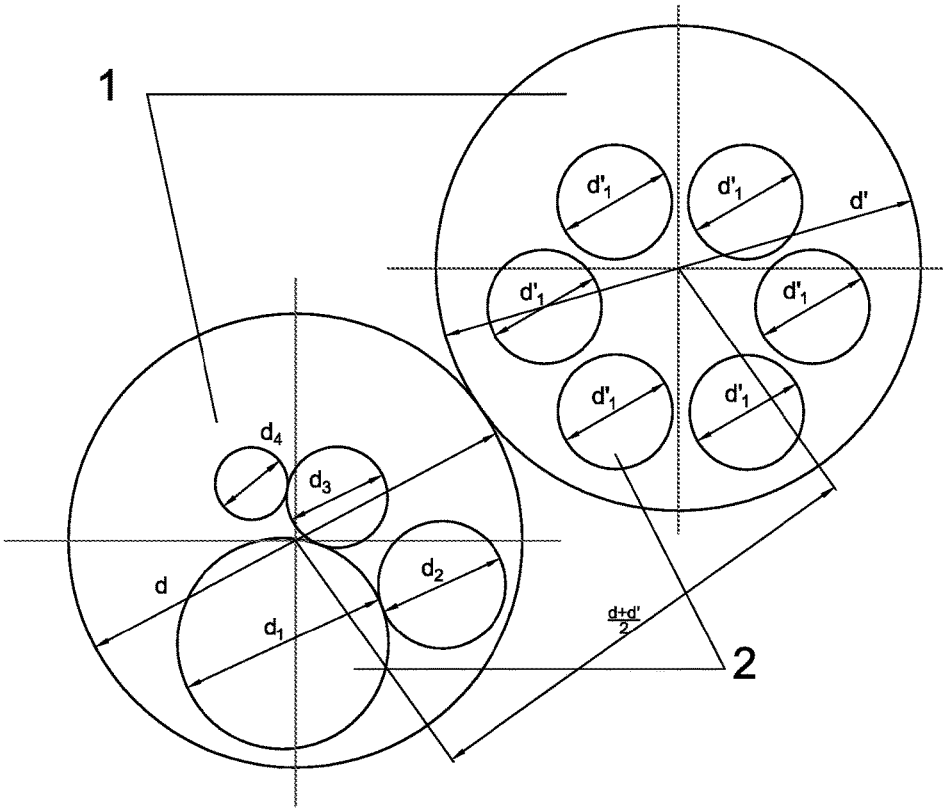
FIG. 12 is a structural sketch view of an eighth combination manner of the modular cutting element according to an embodiment 8 of the present invention.

As shown in FIG. 12 of the drawings, a modular cutting-teeth drill bit with controllable drilling specific pressure comprises modules (1) and modular units (2). In this combination manner, no distance is provided between the modules, i.e. a distance value of some modules is 0 mm.

Embodiment 9: PDC Bit

Figure 1:
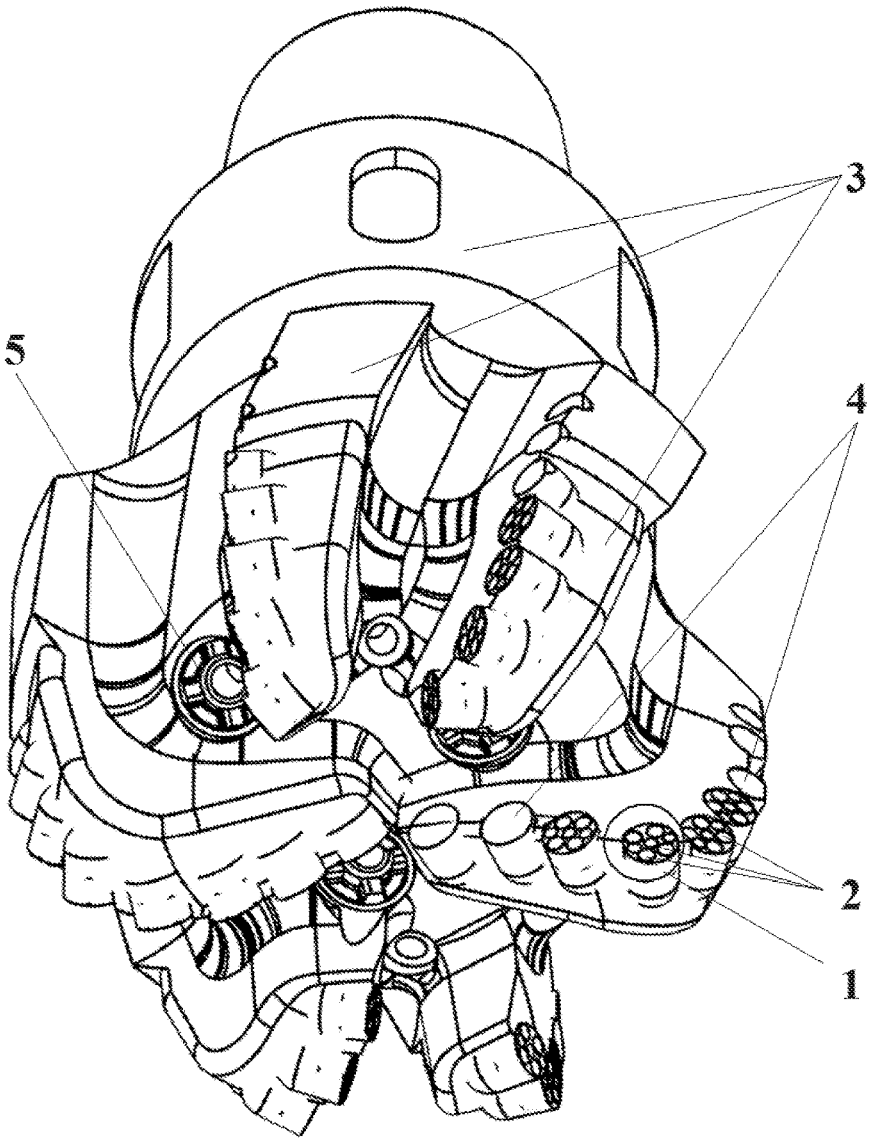
FIG. 1 is a sketch view of a modular cutting-teeth drill bit with controllable drilling specific pressure (PDC Bits) according to a preferred embodiment of the present invention.
Figure 2:
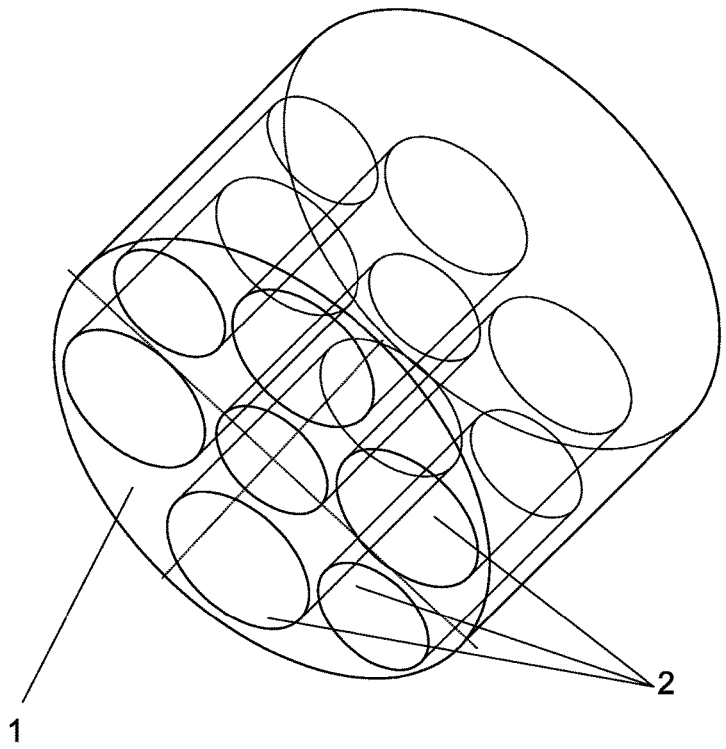
FIG. 2 is a structural sketch view of a modular cutting element according to a preferred embodiment of the present invention.

As shown in FIG. 1 of the drawings, a modular cutting-teeth drill bit with controllable drilling specific pressure comprises a module (1), a modular unit (2), a bit body (3), a PDC cutting teeth (4) and a nozzle (5), wherein the bit thereof comprises at least one cutting element (see FIG. 2 of the drawings) formed by the module or the modular unit of the present invention, and a plurality of the cutting elements constitute the PDC cutting teeth (4).

Embodiment 10: Compact Bit

Figure 13:
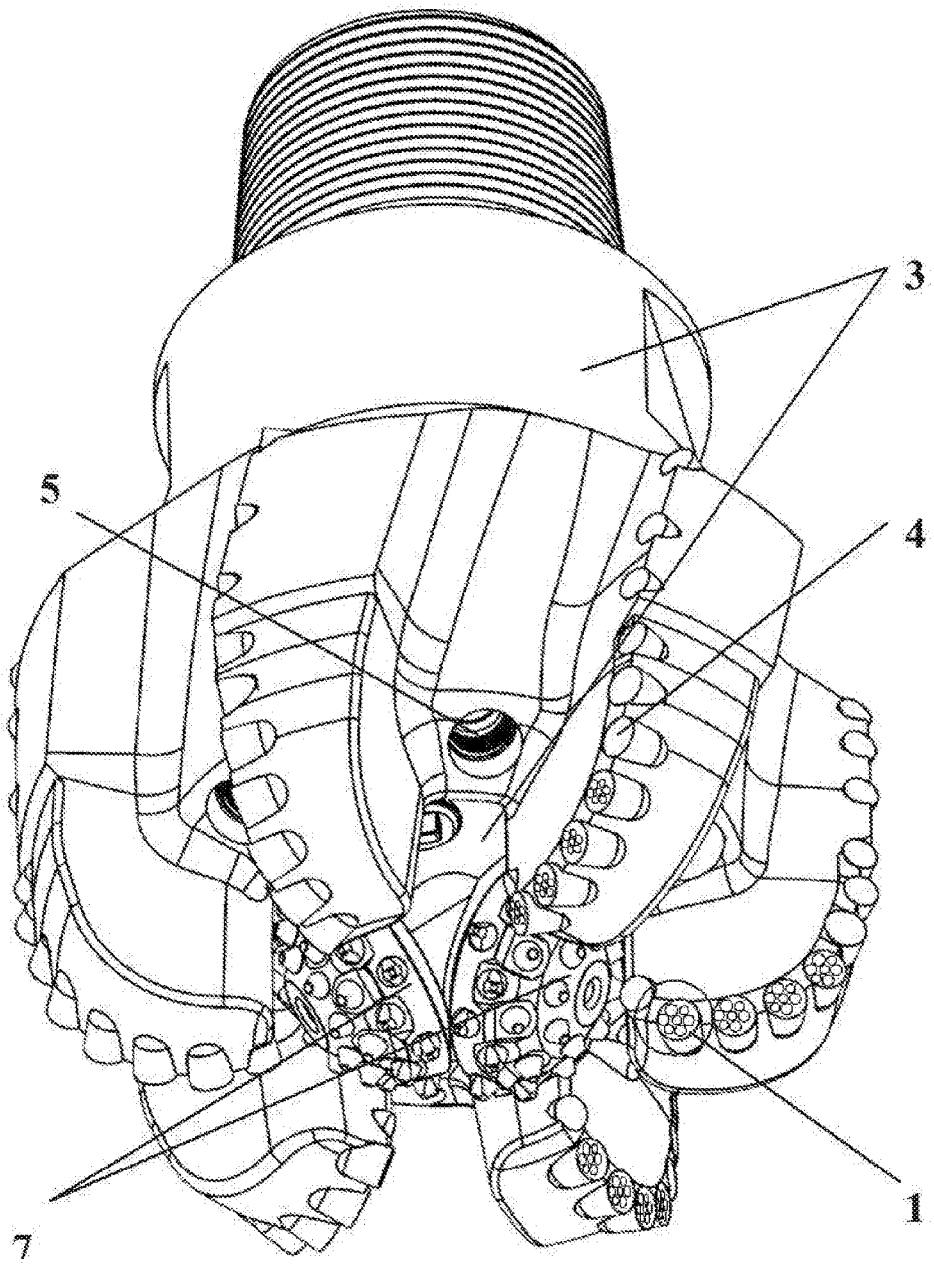
FIG. 13 is a structural sketch view of the modular cutting-teeth bit (a compact bit comprising a PDC bit and a cone-cutting bit) according to a preferred embodiment of the present invention.

As shown in FIG. 13 of the drawings, a compact bit comprises a cone-cutting bit and a modular PDC bit. A modular cutting-teeth drill bit with controllable drilling specific pressure comprises a module (1), modular units (2), a PDC bit body (3), a PDC cutting teeth (4), a nozzle (5) and a cone-cutting bit, wherein the bit thereof comprises at least one cutting element (see FIG. 2 of the drawings) formed by the module or the modular unit of the present invention, and a plurality of the cutting elements constitute the PDC cutting teeth (4).

Embodiment 11: Theoretical Analysis

According to research ideas of the present invention, designs of modular cutting-teeth bit of different solutions can be completed. The solution in the FIG. 3 is chosen for serving as an example for analysis.

As shown in FIG. 3 of the drawings, a number of the modular unit is 2. Cross-section shapes of a module and the module unit are circles. A diameter of the module is d. The two modular units are provided in the two modules. Two kinds of modular units are provided. A total number of two modular units are provided, which are respectively a modular unit 1 and a modular unit 2. Diameters of the modular unit 1 and the modular unit 2 are respectively $d_1$ and $d_2$. A center distance along a Y axis direction of the modular unit 1 to the modular unit 2 is $h_1$, wherein $$0 \le h_1 \le \frac{d_1 + d_2}{2}.$$

Distribution rules of the cutting-edge length of the cutting element which comprises the module 1 and the modular units 2 in different drilling processes are analyzed as following.

When the module 1 works alone, i.e., $$0 \le y \le \left(\frac{d_1}{2} + h_1 - \frac{d_2}{2}\right),$$

a point of the module 1 is set as ($x_1$, $y_1$), the cutting-edge length thereof is calculated as:

$$l_{1d_1} = \begin{cases} 2\left[\left(\frac{d_1}{2}\right)^2 - \left(\frac{d_1}{2} - y\right)^2\right]^{\frac{1}{2}} \\ 0 \le y \le \left(\frac{d_1}{2} + h_1 - \frac{d_2}{2}\right) \end{cases}$$

Corresponding to the module having a diameter of d, a cutting-edge length corresponding to the point ($x_{1'}$, $y_{1'}$) in FIG. 3 is:

$$l_{1'd} = \begin{cases} 2\left[\left(\frac{d}{2}\right)^2 - \left(\frac{d}{2} - y\right)^2\right]^{\frac{1}{2}} \\ 0 \le y \le \left(\frac{d_1}{2} + h_1 - \frac{d_2}{2}\right) \end{cases}$$

When the module 1 and the modular unit 2 work together, a point is set as ($x_2$, $y_2$), the cutting-edge length thereof is calculated as:

$$l_{12d_1d_2} = \begin{cases} 2\left\{\left[\left(\frac{d_2}{2}\right)^2 - \left(\frac{d_1}{2} + h_1 - y\right)^2\right]^{\frac{1}{2}} + \left[\left(\frac{d_1}{2}\right)^2 - \left(y - \frac{d_1}{2}\right)^2\right]^{\frac{1}{2}}\right\} \\ \left(\frac{d_1}{2} + h_1 - \frac{d_2}{2}\right) < y \le d_1 \end{cases}$$

Corresponding to the cutting element having the diameter of d, a cutting-edge length corresponding to the point ($x_{2'}$, $y_{2'}$) in FIG. 3 is:

$$l_{1'2'd} = \begin{cases} 2\left[\left(\frac{d}{2}\right)^2 - \left(\frac{d}{2} - y\right)^2\right]^{\frac{1}{2}} \\ \left(\frac{d_1}{2} + h_1 - \frac{d_2}{2}\right) < y \le d_1. \end{cases}$$

When the modular unit 2 works alone, i.e., $$d_1 < y \le \left(\frac{d_1}{2} + h_1 + \frac{d_2}{2}\right),$$

a point thereof is set as ($x_3$, $y_3$), and the cutting-edge length thereof is calculated as:

$$l_{3d_2} = \begin{cases} 2\left[\left(\frac{d_2}{2}\right)^2 - \left(\frac{d_1}{2} + h_1 - y\right)^2\right]^{\frac{1}{2}} \\ d_1 < y \le \left(\frac{d_1}{2} + h_1 + \frac{d_2}{2}\right). \end{cases}$$

Corresponding to the cutting element having the diameter of d, a cutting-edge length corresponding to the point ($x_{3'}$, $y_{3'}$) in FIG. 3 is:

$$l_{3'd} = \begin{cases} 2\left[\left(\frac{d}{2}\right)^2 - \left(\frac{d}{2} - y\right)^2\right]^{\frac{1}{2}} \\ d_1 < y \le \left(\frac{d_1}{2} + h_1 + \frac{d_2}{2}\right). \end{cases}$$

Comparative Analysis of the Cutting Edge Lengths

Corresponding to a same radial depth (coordinate value along a Y axis, $l_{1'd}$, $l_{1d_1}$, $l_{1'2'd}$, $l_{12d_1d_2}$, $l_{3'd}$ and $l_{3d_2}$ which are respectively cutting edge lengths of diameters d, $d_1$ and $d_2$ are compared as shown in FIG. 3 of the drawings.

Analysis result of the module and the modular unit shows that compared with the conventional cutting element, the modular cutting-teeth bit controls effective abrasion edge length of the cutting element on a certain portion thereof, and maintains a constant specific pressure of the cutting element of the bit during the drilling process by controlling a combination of shapes, sizes and numbers of the module and the modular unit is optimized; effective abrasion edge length of the cutting element on a certain portion thereof. According to relationship among the cutting-edge length, the specific pressure and the ROP, increase of the cutting-edge length dramatically reduces breaking efficiency of the rocks the ROP. By controlling the cutting-edge length, thus, the specific pressure still maintains a greater drilling depth corresponding to the bit pressure and properties of the rocks, so as to ensure penetration of the cutting element and realize improving the ROP of the bit.

Embodiment 12

A modular PDC bit manufactured according to designing of the present invention having a size of 8.5", a number of blade wings thereof is 6, and a diameter of a main cutting tooth is 16 mm.

Actual data in drilling process:

(1) well section utilized: 2879 m~2965 m;

(2) lithology: light gray fine-grained sandstone and medium-grained sandstone (quartz-bearing), grayish white medium-grained sandstone (quartz-bearing) and black carbonaceous shale;

(3) Bit pressure: 60~70 KN;

(4) Rotating speed: 60~75 rpm;

(5) Displacement: 421/m;

(6) Average ROP: 6.33 m/h.

Figure 14:
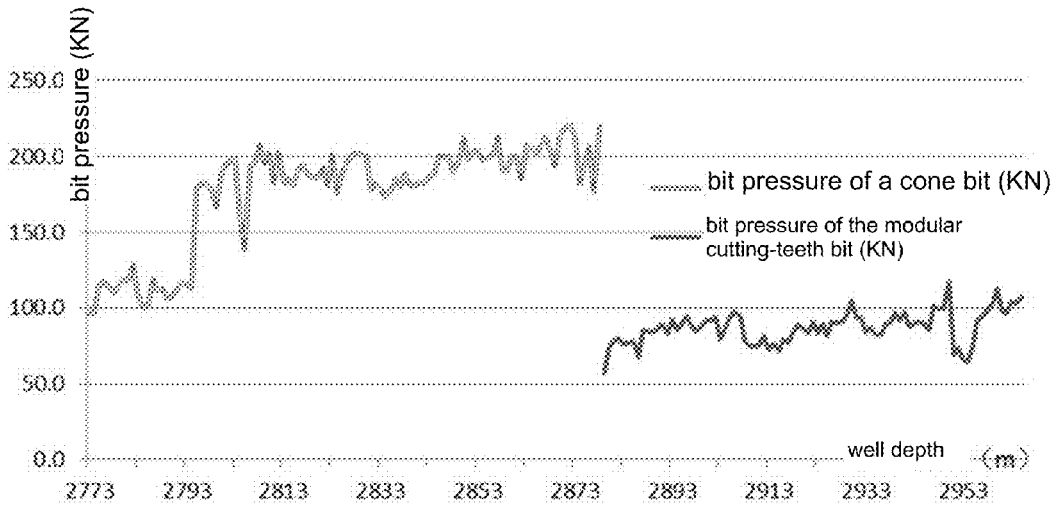
FIG. 14 is a contrast diagram of bit pressure of a three-cone bit to the present invention applied in the PDC bit while drilling hard strata and high abrasive property strata.
Figure 15:
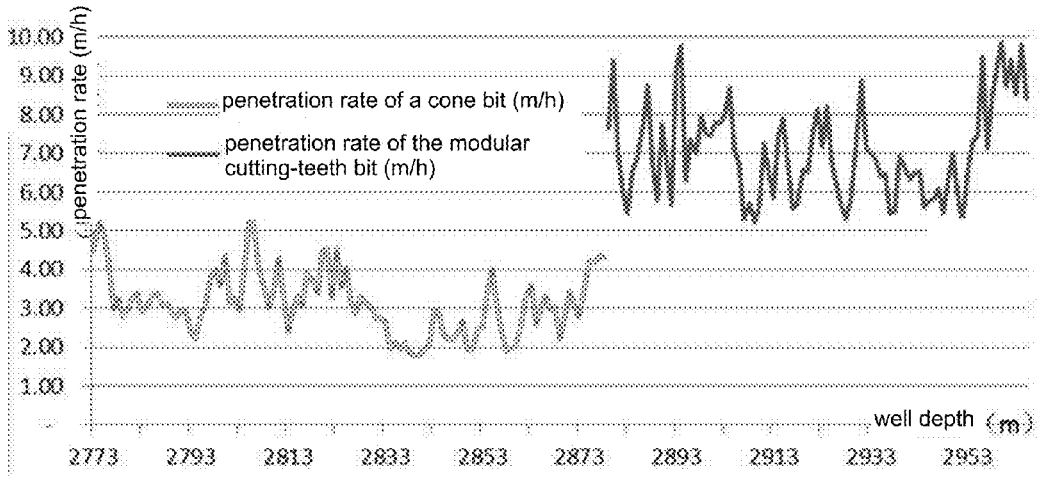
FIG. 15 is a contrast diagram of bit pressure of a three-cone bit to the present invention applied in the PDC bit while drilling hard strata and high abrasive property strata.

As shown in FIG. 14 and FIG. 15 of the drawings, results of the embodiments show that compared with a three-cone bit, the modular cutting-teeth bit greatly reduced drilling pressure while drilling hard strata and high abrasive strata, and ROP thereof is significantly improved and remains stable.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A modular cutting-teeth bit having controllable specific pressure for drilling, comprising: a module and a modular unit, wherein modular cutting teeth of said modular cutting-teeth bit having controllable specific pressure for drilling comprise said module for serving as matrix and said modular unit, a number of said module provided on said modular cutting-teeth bit is not less than 1, and a number of said modular unit provided on said module is not less than 2;

wherein types thereof are selected from the group consisting of a PDC bit, a diamond bit, an impregnated bit, a roller bit, a cone-cutting bit and a compact bit comprising at least two number selected from the group consisting of said PDC bit, said impregnated bit, said roller bit and said cone-cutting bit, wherein a material of a bit body thereof is selected from the group consisting of a sintered body of tungsten carbide and alloy, steel, cemented carbide and metal matrix composite;

a number of the modular unit is 2, cross-section shapes of the module and the module unit are circles, a diameter of the module is d, two kinds of modular units are provided, a total number of two modular units are provided, which are respectively a first modular unit and a second modular unit, diameters of the first modular unit and the second modular unit are respectively $d_1$, and $d_2$, a center distance along a Y axis direction of the first modular unit to the second modular unit is $h_1$, wherein $$0 \leq h_1 \leq \frac{d_1 + d_2}{2}.$$

* * * * *